US009752781B2

(12) United States Patent
Stuttaford et al.

(10) Patent No.: US 9,752,781 B2
(45) Date of Patent: Sep. 5, 2017

(54) FLAMESHEET COMBUSTOR DOME

(71) Applicant: ANSALDO ENERGIA IP UK LIMITED, London (GB)

(72) Inventors: Peter John Stuttaford, Jupiter, FL (US); Stephen Jorgensen, Palm City, FL (US); Timothy Hui, Palm Beach Gardens, FL (US); Yan Chen, Woodinville, WA (US); Hany Rizkalla, Stuart, FL (US); Khalid Oumejjoud, Palm Beach Gardens, FL (US)

(73) Assignee: ANSALDO ENERGIA IP UK LIMITED (GB)

( * ) Notice: Subject to any disclaimer, the term of this patent is extended or adjusted under 35 U.S.C. 154(b) by 771 days.

(21) Appl. No.: 14/038,064

(22) Filed: Sep. 26, 2013

(65) Prior Publication Data

US 2014/0090390 A1 Apr. 3, 2014

Related U.S. Application Data

(60) Provisional application No. 61/708,323, filed on Oct. 1, 2012.

(51) Int. Cl.
*F23R 3/54* (2006.01)
*F23R 3/26* (2006.01)
(Continued)

(52) U.S. Cl.
CPC ..... *F23R 3/54* (2013.01); *F23R 3/14* (2013.01); *F23R 3/16* (2013.01); *F23R 3/26* (2013.01);
(Continued)

(58) Field of Classification Search
CPC .... F23R 3/16; F23R 3/343; F23R 3/14; F23R 3/34; F23R 3/54; F23R 3/286; F23R 3/26; F23R 3/60; F23R 2900/00014; F23R 2900/03343; F23C 2900/06043; F23C 2900/07001; F23C 2201/20
See application file for complete search history.

(56) References Cited

U.S. PATENT DOCUMENTS 2,457,157 A 12/1948 King, Jr.
3,759,038 A 9/1973 Scalzo et al.
(Continued)

FOREIGN PATENT DOCUMENTS

EP 0747635 12/1996
WO 9906767 A1 2/1999

OTHER PUBLICATIONS

Non-Final Office Action dated Sep. 23, 2015 in U.S. Appl. No. 14/038,016, 20 pages.
(Continued)

*Primary Examiner* — Carlos A Rivera
(74) *Attorney, Agent, or Firm* — Hovey Williams LLP

(57) ABSTRACT

The present invention discloses a novel apparatus and way for controlling a velocity of a fuel-air mixture entering a gas turbine combustion system. The apparatus comprises a hemispherical dome assembly which directs a fuel-air mixture along a portion of the outer wall of a combustion liner and turns the fuel-air mixture to enter the combustion liner in a manner coaxial to the combustor axis and radially outward of a pilot fuel nozzle so as to regulate the velocity of the fuel-air mixture.

8 Claims, 5 Drawing Sheets

(51) Int. Cl.

| | |
|---|---|
| ***F23R 3/60*** | (2006.01) |
| ***F23R 3/14*** | (2006.01) |
| ***F23R 3/16*** | (2006.01) |
| ***F23R 3/34*** | (2006.01) |
| ***F23R 3/28*** | (2006.01) |

(52) U.S. Cl.

CPC ..... *F23R 3/286* (2013.01); *F23R 3/34* (2013.01); *F23R 3/343* (2013.01); *F23R 3/60* (2013.01); *F23C 2201/20* (2013.01); *F23C 2900/06043* (2013.01); *F23C 2900/07001* (2013.01); *F23R 2900/00014* (2013.01); *F23R 2900/03343* (2013.01)

(56) References Cited

U.S. PATENT DOCUMENTS

| | | | | |
|---|---|---|---|---|
| 4,735,052 | A | 4/1988 | Maeda et al. | |
| 4,910,957 | A | 3/1990 | Moreno et al. | |
| 4,928,481 | A | 5/1990 | Joshi et al. | |
| 5,121,597 | A | 6/1992 | Urushidani et al. | |
| 5,129,226 | A | 7/1992 | Bigelow | |
| 5,319,935 | A | 6/1994 | Toon et al. | |
| 5,452,574 | A | 9/1995 | Cowell et al. | |
| 5,584,684 | A | 12/1996 | Dobbeling et al. | |
| 5,676,538 | A | 10/1997 | Lovett | |
| 5,802,854 | A | 9/1998 | Maeda et al. | |
| 5,983,642 | A | 11/1999 | Parker | |
| 6,056,538 | A | 5/2000 | Buechner et al. | |
| 6,094,916 | A | 8/2000 | Puri et al. | |
| 6,513,334 | B2 | 2/2003 | Varney | |
| 6,558,154 | B2 | 5/2003 | Eroglu et al. | |
| 6,634,175 | B1 * | 10/2003 | Kawata | F23R 3/04 60/746 |
| 6,935,116 | B2 | 8/2005 | Stuttaford et al. | |
| 6,986,254 | B2 | 1/2006 | Stuttaford et al. | |
| 7,093,445 | B2 * | 8/2006 | Corr, II | F23R 3/40 60/723 |
| 7,137,256 | B1 | 11/2006 | Stuttaford et al. | |
| 7,237,384 | B2 | 7/2007 | Stuttaford et al. | |
| 7,308,793 | B2 | 12/2007 | Oumejjoud et al. | |
| 7,373,778 | B2 | 5/2008 | Bunker et al. | |
| 7,513,115 | B2 | 4/2009 | Stuttaford | |
| 7,540,152 | B2 * | 6/2009 | Tanimura | F23R 3/04 60/737 |
| 7,677,025 | B2 | 3/2010 | Stuttaford et al. | |
| 7,770,395 | B2 * | 8/2010 | Tanimura | F23R 3/04 60/737 |
| 7,886,545 | B2 | 2/2011 | Lacy et al. | |
| 8,448,444 | B2 | 5/2013 | Cihlar et al. | |
| 8,656,721 | B2 | 2/2014 | Matsumoto et al. | |
| 2004/0006993 | A1 | 1/2004 | Stuttaford et al. | |
| 2006/0168966 | A1 | 8/2006 | Stuttaford et al. | |
| 2007/0089419 | A1 | 4/2007 | Matsumoto et al. | |
| 2008/0083224 | A1 | 4/2008 | Varatharajan et al. | |
| 2009/0111063 | A1 | 4/2009 | Boardman | |
| 2010/0319349 | A1 * | 12/2010 | Rajaram | F02C 7/24 60/725 |
| 2010/0319350 | A1 | 12/2010 | Landry et al. | |
| 2010/0326079 | A1 * | 12/2010 | Zuo | F23R 3/286 60/748 |
| 2011/0016867 | A1 * | 1/2011 | Milosavljevic | F23R 3/286 60/737 |
| 2011/0067402 | A1 | 3/2011 | Wiebe et al. | |
| 2011/0094233 | A1 | 4/2011 | Kashihara et al. | |
| 2011/0113784 | A1 | 5/2011 | Headland et al. | |
| 2011/0185703 | A1 | 8/2011 | Dodo et al. | |
| 2011/0296839 | A1 | 12/2011 | Van Nieuwenhuizen et al. | |
| 2012/0045725 | A1 | 2/2012 | Takiguchi et al. | |
| 2012/0047897 | A1 | 3/2012 | Hirata et al. | |
| 2012/0186256 | A1 * | 7/2012 | Dai | F23C 7/004 60/737 |
| 2014/0090389 | A1 | 4/2014 | Stuttaford et al. | |
| 2014/0090396 | A1 | 4/2014 | Stuttaford et al. | |
| 2014/0090400 | A1 | 4/2014 | Stuttaford et al. | |
| 2015/0075172 | A1 | 3/2015 | Stuttaford et al. | |
| 2015/0184856 | A1 | 7/2015 | Stuttaford et al. | |
| 2015/0184858 | A1 | 7/2015 | Stuttaford et al. | |

OTHER PUBLICATIONS

International Search Report with Written Opinion mailed Jun. 27, 2014 in PCT Application No. PCT/US2013/062678, 11 pages.

PCT Application No. US2013/062693, Search Report dated Mar. 14, 2014, 11 pages.

PCT Application No. US2013/062668, Search Report dated Mar. 24, 2014, 60 pages.

PCT Application No. US2013/062688, Search Report dated Mar. 24, 2014, 17 pages.

PCT Application No. US2013/062673 Search Report and Written Opinion dated Apr. 11, 2014.

U.S. Appl. No. 14/038,016, filed Sep. 26, 2013, 69 pages.

U.S. Appl. No. 14/038,029, filed Sep. 26, 2013, 64 pages.

U.S. Appl. No. 14/038,038, filed Sep. 26, 2013, 50 pages.

U.S. Appl. No. 14/038,056, filed Sep. 26, 2013, 51 pages.

U.S. Appl. No. 14/038,070, filed Sep. 26, 2013, 74 pages.

Non-Final Office Action dated Mar. 24, 2016 in U.S. Appl. No. 14/038,070, 20 pages.

Non-Final Office Action dated Mar. 25, 2016 in U.S. Appl. No. 14/038,064, 14 pages.

Non-Final Office Action dated May 2, 2016 in U.S. Appl. No. 14/038,056, 10 pages.

Non-Final Office Action dated May 16, 2016 in U.S. Appl. No. 14/038,029, 14 pages.

Notice of Allowance dated Jan. 20, 2016 in U.S. Appl. No. 14/038,016, 9 pages.

Non-Final Office Action dated Feb. 11, 2016 in U.S. Appl. No. 14/038,038, 10 pages.

* cited by examiner

FLAMESHEET COMBUSTOR DOME

CROSS-REFERENCE TO RELATED APPLICATIONS

This application claims the benefit of U.S. Provisional Patent Application Ser. No. 61/708,323 filed on Oct. 1, 2012.

TECHNICAL FIELD

The present invention relates generally to an apparatus and method for directing a fuel-air mixture into a combustion system. More specifically, a hemispherical dome is positioned proximate an inlet to a combustion liner to direct the fuel-air mixture in a more effective way to better control the velocity of the fuel-air mixture entering the combustion liner.

BACKGROUND OF THE INVENTION

In an effort to reduce the amount of pollution emissions from gas-powered turbines, governmental agencies have enacted numerous regulations requiring reductions in the amount of oxides of nitrogen (NOx) and carbon monoxide (CO). Lower combustion emissions can often be attributed to a more efficient combustion process, with specific regard to fuel injector location, airflow rates, and mixing effectiveness.

Early combustion systems utilized diffusion type nozzles, where fuel is mixed with air external to the fuel nozzle by diffusion, proximate the flame zone. Diffusion type nozzles historically produce relatively high emissions due to the fact that the fuel and air burn essentially upon interaction, without mixing, and stoichiometrically at high temperature to maintain adequate combustor stability and low combustion dynamics.

An alternate means of premixing fuel and air and obtaining lower emissions can occur by utilizing multiple combustion stages. In order to provide a combustor with multiple stages of combustion, the fuel and air, which mix and burn to form the hot combustion gases, must also be staged. By controlling the amount of fuel and air passing into the combustion system, available power as well as emissions can be controlled. Fuel can be staged through a series of valves within the fuel system or dedicated fuel circuits to specific fuel injectors. Air, however, can be more difficult to stage given the large quantity of air supplied by the engine compressor. In fact, because of the general design to gas turbine combustion systems, as shown by FIG. 1, air flow to a combustor is typically controlled by the size of the openings in the combustion liner itself, and is therefore not readily adjustable. An example of the prior art combustion system 100 is shown in cross section in FIG. 1. The combustion system 100 includes a flow sleeve 102 containing a combustion liner 104. A fuel injector 106 is secured to a casing 108 with the casing 108 encapsulating a radial mixer 110. Secured to the forward portion of the casing 108 is a cover 112 and pilot nozzle assembly 114.

However, while premixing fuel and air prior to combustion has been shown to help lower emissions, the amount of fuel-air premixture being injected has a tendency to vary due to a variety of combustor variables. As such, obstacles still remain with respect to controlling the amount of a fuel-air premixture being injected into a combustor.

SUMMARY

The present invention discloses an apparatus and method for improving control of the fuel-air mixing prior to injection of the mixture into a combustion liner of a multi-stage combustion system. More specifically, in an embodiment of the present invention, a gas turbine combustor is provided having a generally cylindrical flow sleeve and a generally cylindrical combustion liner contained therein. The gas turbine combustor also comprises a set of main fuel injectors and a combustor dome assembly encompassing the inlet end of a combustion liner and having a generally hemispherical cross section. The dome assembly extends both axially towards the set of main fuel injectors and within the combustion liner to form a series of passageways through which a fuel-air mixture passes, where the passageways are sized accordingly to regulate the flow of the fuel-air premixture.

In an alternate embodiment of the present invention, a dome assembly for a gas turbine combustor is disclosed. The dome assembly comprises an annular, hemispherical-shaped cap extending about the axis of the combustor, an outer annular wall secured to a radially outer portion of the hemispherical-shaped cap and an inner annular wall also secured to a radially inner portion of the hemispherical-shaped cap. The resulting dome assembly has a generally U-shaped cross section sized to encompass an inlet portion of a combustion liner.

In yet another embodiment of the present invention, a method of controlling a velocity of a fuel-air mixture for a gas turbine combustor is disclosed. The method comprises directing a fuel-air mixture through a first passageway located radially outward of a combustion liner and then directing the fuel-air mixture from the first passageway through a second passageway located adjacent to the first passageway. The fuel-air mixture is then directed from the second passageway and through a fourth passageway formed by a hemispherical dome cap, thereby causing the fuel-air mixture to reverse direction. The fuel-air mixture then passes through a third passageway that is located within the combustion liner.

Additional advantages and features of the present invention will be set forth in part in a description which follows, and in part will become apparent to those skilled in the art upon examination of the following, or may be learned from practice of the invention. The instant invention will now be described with particular reference to the accompanying drawings.

BRIEF DESCRIPTION OF THE SEVERAL VIEWS OF THE DRAWINGS

The present invention is described in detail below with reference to the attached drawing figures, wherein.

DETAILED DESCRIPTION

By way of reference, this application incorporates the subject matter of U.S. Pat. Nos. 6,935,116, 6,986,254, 7,137,256, 7,237,384, 7,308,793, 7,513,115, and 7,677,025.

The present invention discloses a system and method for controlling velocity of a fuel-air mixture being injected into a combustion system. That is, a predetermined effective flow area is maintained through two co-axial structures forming an annulus of a known effective flow area through which a fuel-air mixture passes.

Figure 1:
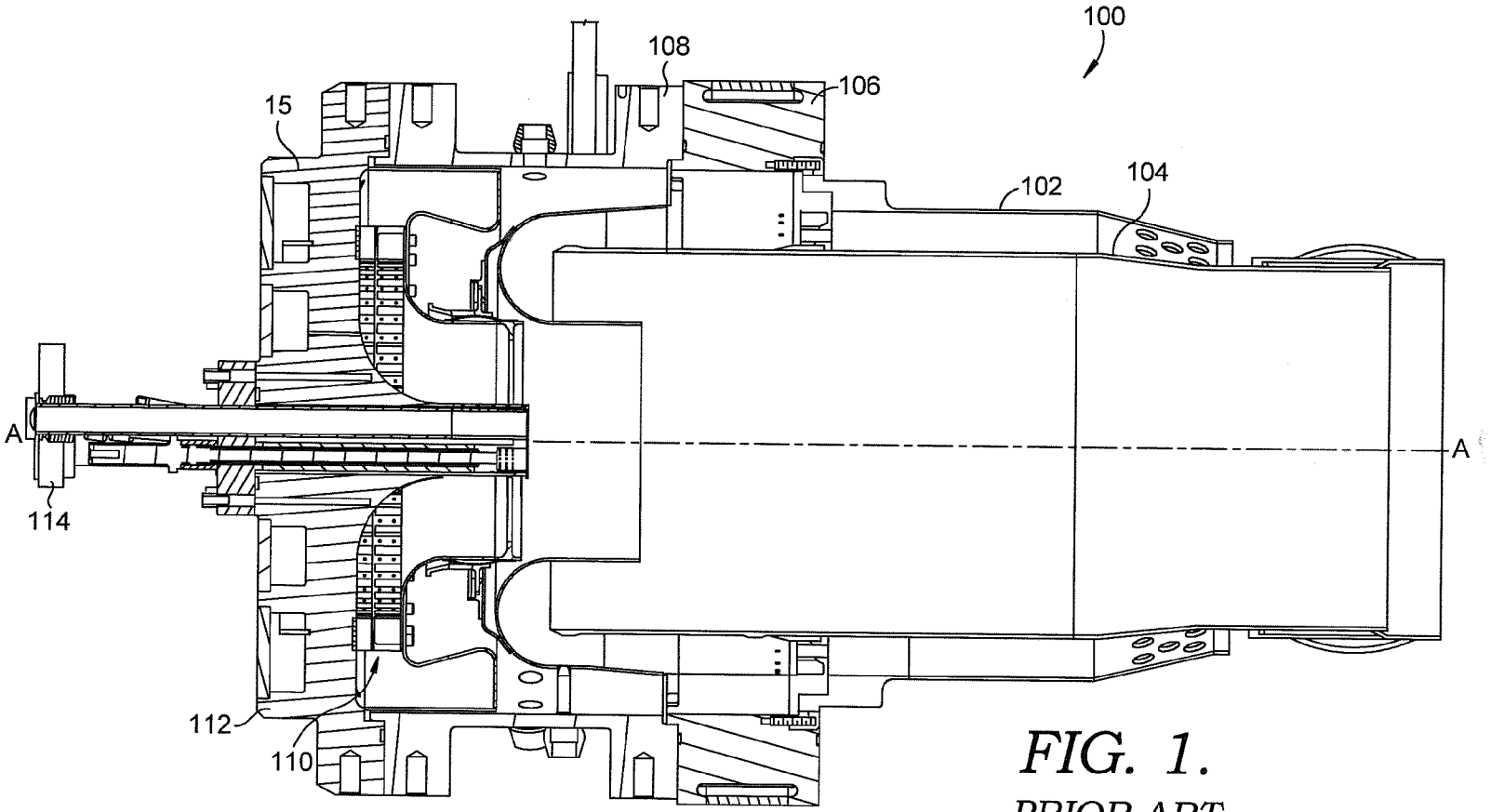
FIG. 1. PRIOR ART
FIG. 1 is a cross section of a combustion system of the prior art.
Figure 2:
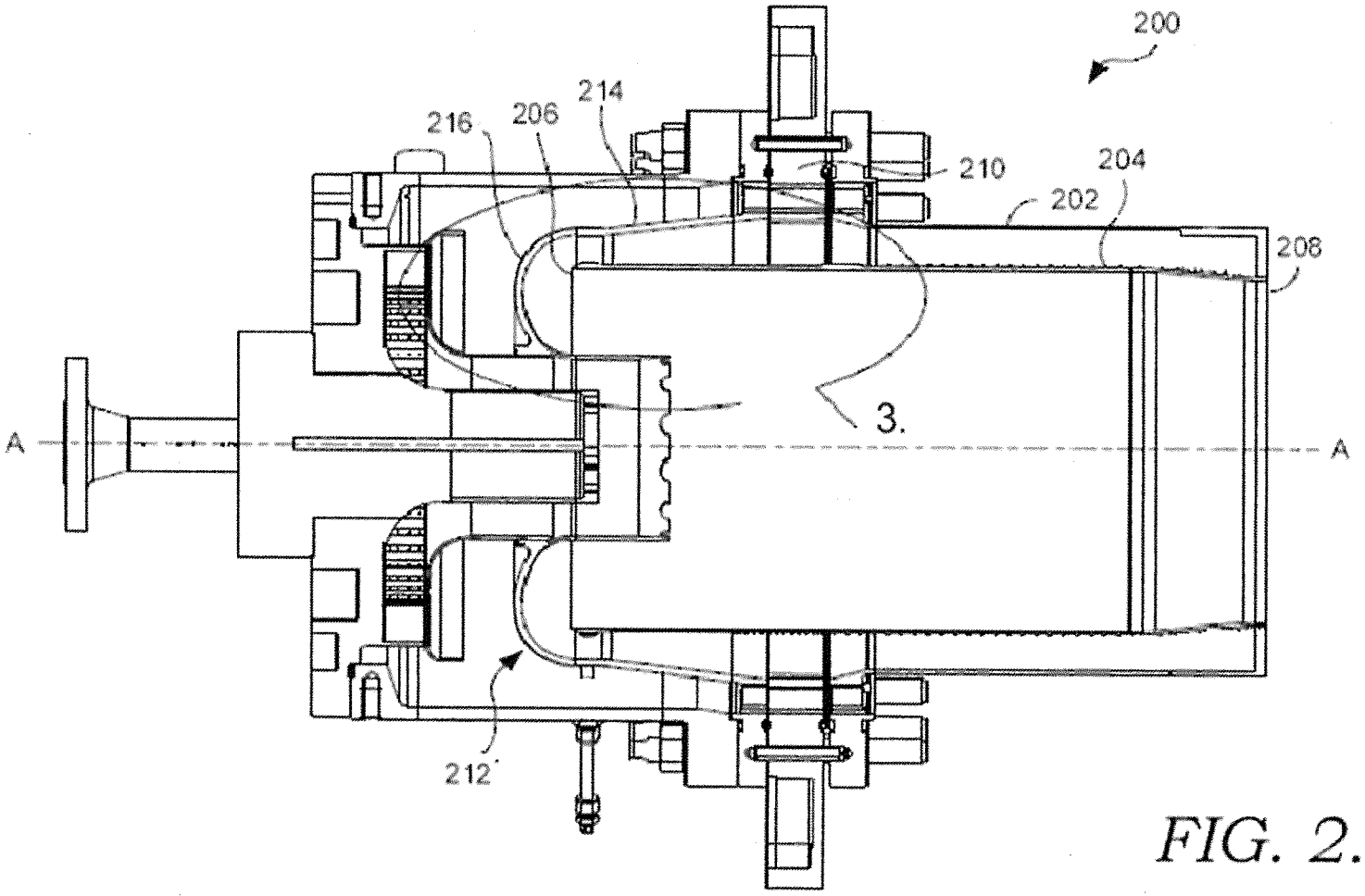
FIG. 2 is a cross section of a gas turbine combustor in accordance with an embodiment of the present invention.

The present invention will now be discussed with respect to FIGS. 2-5. An embodiment of a gas turbine combustion system 200 in which the present invention operates is depicted in FIG. 2. The combustion system 200 is an example of a multi-stage combustion system and extends about a longitudinal axis A-A and includes a generally cylindrical flow sleeve 202 for directing a predetermined amount of compressor air along an outer surface of a generally cylindrical and co-axial combustion liner 204. The combustion liner 204 has an inlet end 206 and opposing outlet end 208. The combustion system 200 also comprises a set of main fuel injectors 210 that are positioned radially outward of the combustion liner 204 and proximate an upstream end of the flow sleeve 202. The set of main fuel injectors 210 direct a controlled amount of fuel into the passing air stream to provide a fuel-air mixture for the combustion system 200.

For the embodiment of the present invention shown in FIG. 2, the main fuel injectors 210 are located radially outward of the combustion liner 204 and spread in an annular array about the combustion liner 204. The main fuel injectors 210 are divided into two stages with a first stage extending approximately 120 degrees about the combustion liner 204 and a second stage extending the remaining annular portion, or approximately 240 degrees, about the combustion liner 204. The first stage of the main fuel injectors 210 are used to generate a Main 1 flame while the second stage of the main fuel injectors 210 generate a Main 2 flame.

Figure 3:
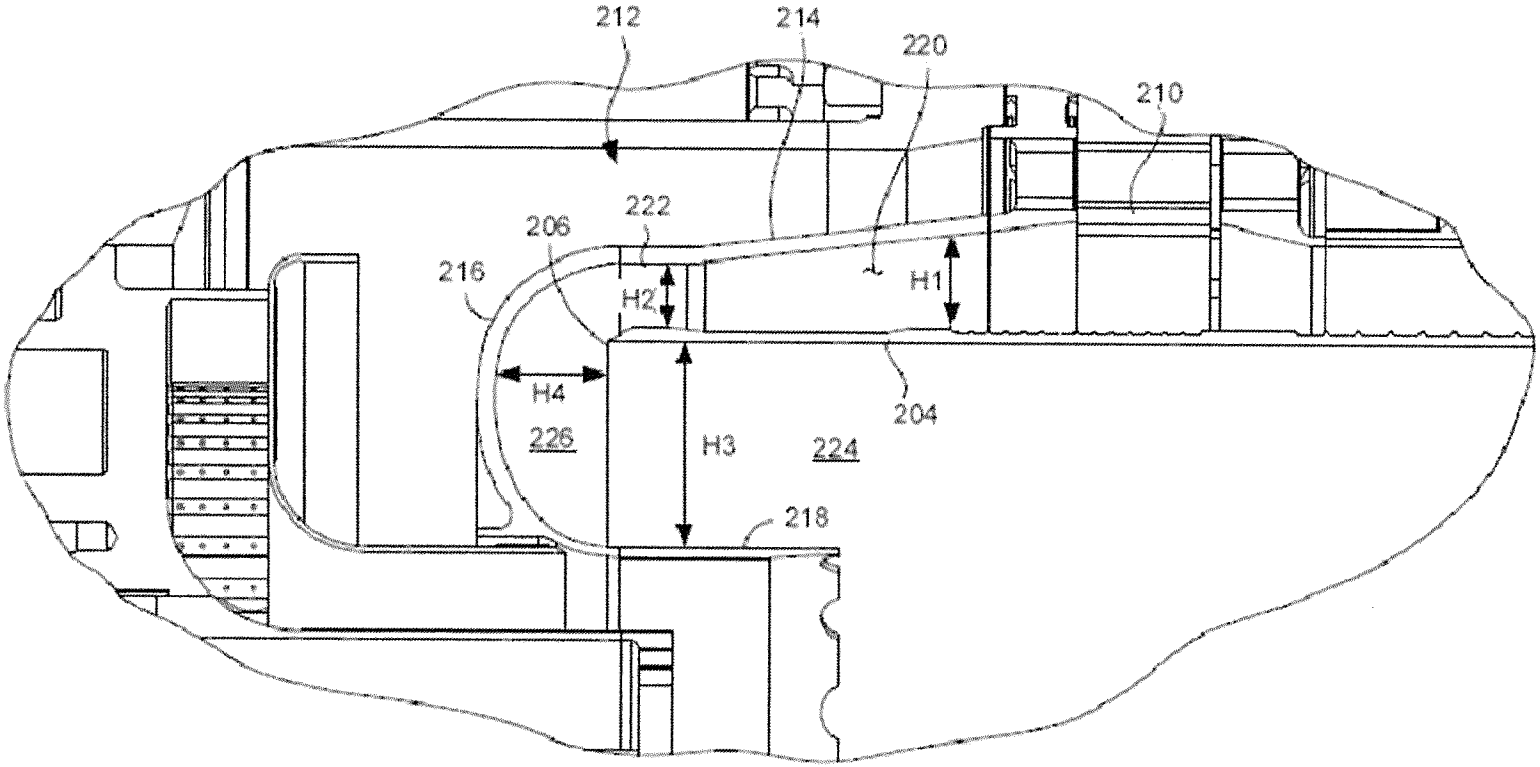
FIG. 3 is a detailed cross section of a portion of the gas turbine combustor of FIG. 2 in accordance with an embodiment of the present invention.
Figure 4B:
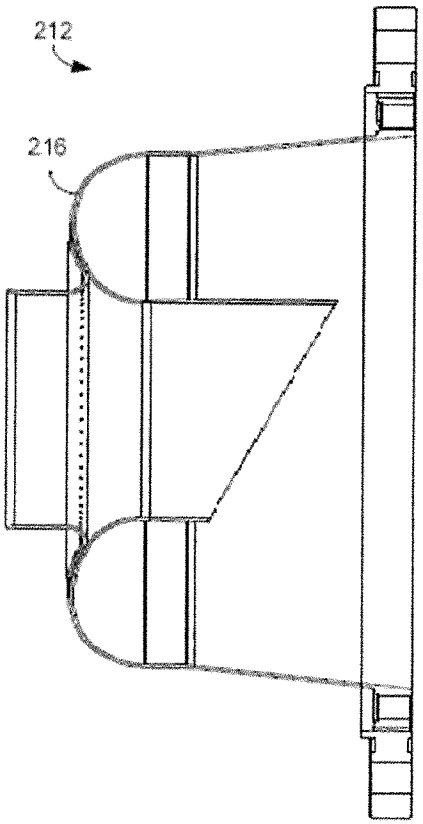
FIG. 4B is a cross section view of a dome assembly in accordance with an alternate embodiment of the present invention.
Figure 4A:
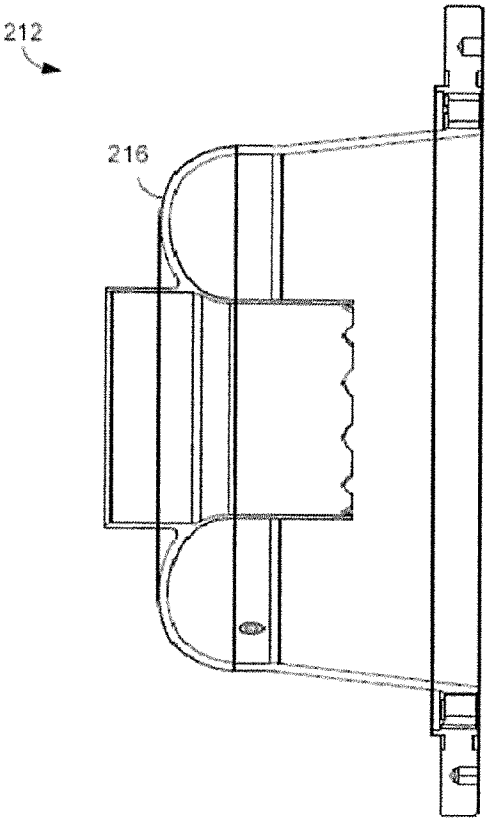
FIG. 4A is a cross section view of a dome assembly in accordance with an embodiment of the present invention.

The combustion system 200 also comprises a combustor dome assembly 212, which, as shown in FIGS. 2 and 3, encompasses the inlet end 206 of the combustion liner 204. More specifically, the dome assembly 212 has an outer annular wall 214 that extends from proximate the set of main fuel injectors 210 to a generally hemispherical-shaped cap 216, which is positioned a distance forward of the inlet end 206 of the combustion liner 204. The dome assembly 212 turns through the hemispherical-shaped cap 216 and extends a distance into the combustion liner 204 through a dome assembly inner wall 218.

As a result of the geometry of the combustor dome assembly 212 in conjunction with the combustion liner 204, a series of passageways are formed between parts of the combustor dome assembly 212 and the combustion liner 204. A first passageway 220 is formed between the outer annular wall 214 and the combustion liner 204. Referring to FIG. 3, a first passageway 220 tapers in size, from a first radial height H1 proximate the set of main fuel injectors 210 to a smaller height H2 at a second passageway 222. The first passageway 220 tapers at an angle to accelerate the flow to a target threshold velocity at a location H2 to provide adequate flashback margin. That is, when velocity of a fuel-air mixture is high enough, should a flashback occur in the combustion system, the velocity of the fuel-air mixture through the second passageway will prevent a flame from being maintained in this region.

The second passageway 222 is formed between a cylindrical portion of the outer annular wall 214 and the combustion liner 204, proximate the inlet end 206 of the combustion liner and is in fluid communication with the first passageway 220. The second passageway 222 is formed between two cylindrical portions and has a second radial height H2 measured between the outer surface of the combustion liner 204 and the inner surface of the outer annular wall 214. The combustor dome assembly 212 also comprises a third passageway 224 that is also cylindrical and positioned between the combustion liner 204 and inner wall 218. The third passageway has a third radial height H3, and like the second passageway, is formed by two cylindrical walls—combustion liner 204 and dome assembly inner wall 218.

As discussed above, the first passageway 220 tapers into the second passageway 222, which is generally cylindrical in nature. The second radial height H2 serves as the limiting region through which the fuel-air mixture must pass. The radial height H2 is regulated and kept consistent from part-to-part by virtue of its geometry, as it is controlled by two cylindrical (i.e. not tapered) surfaces, as shown in FIG. 3. That is, by utilizing a cylindrical surface as a limiting flow area, better dimensional control is provided because more accurate machining techniques and control of machining tolerances of a cylindrical surface is achievable, compared to that of tapered surfaces. For example, it is well within standard machining capability to hold tolerances of cylindrical surfaces to within +/−0.001 inches.

Utilizing the cylindrical geometry of the second passageway 222 and third passageway 224 provides a more effective way to control and regulate the effective flow area and controlling the effective flow area allows for the fuel-air mixture to be maintained at predetermined and known velocities. By being able to regulate the velocity of the mixture, the velocity can be maintained at a rate high enough to ensure flashback of the flame does not occur in the dome assembly 212.

One such way to express these critical passageway geometries shown in FIGS. 2-4B is through a turning radius ratio of the second passageway height H2 relative to the third passageway height H3. That is, the minimal height relative to the height of the combustion inlet region. For example, in the embodiment of the present invention depicted herein, the ratio of H2/H3 is approximately 0.32. This aspect ratio controls the size of the recirculation and stabilization trapped vortex that resides adjacent to the liner, which effects overall combustor stability. For example, for the embodiment shown in FIGS. 2 and 3, utilizing this geometry permits velocity of the fuel-air mixture in the second passageway to remain within a range of approximately 40-80 meters per second. However, the ratio can vary depending on the desired passageway heights, fuel-air mixture mass flow rate and combustor velocities. For the combustion system disclosed, the ratio of H2/H3 can range from approximately 0.1 to approximately 0.5. More specifically, for an embodiment of the present invention, the first radial height H1 can range from approximately 15 millimeters to approximately 50 millimeters, while the second radial height H2 can range from approximately 10 millimeters to approximately 45 millimeters, and the third radial height H3 can range from approximately 30 millimeters to approximately 100 millimeters.

As discussed above, the combustion system also comprises a fourth passageway 226 having a fourth height H4, where the fourth passageway 226 is located between the inlet end 206 of the combustion liner and the hemispherical-shaped cap 216. As it can be seen from FIG. 3, the fourth passageway 226 is positioned within the hemispherical-shaped cap 216 with the fourth height measured along the distance from the inlet end 206 of the liner to the intersecting location at the hemispherical-shaped cap 216. As such, the fourth height H4 is greater than the second radial height H2, but the fourth height H4 is less than the third radial height H3. This relative height configuration of the second, third and fourth passageways permits the fuel-air mixture to be controlled (at H2), turn through the hemispherical-shaped cap 216 (at H4) and enter the combustion liner 204 (at H3) all in a manner so as to ensure the fuel-air mixture velocity is fast enough that the fuel-air mixture remains attached to the surface of the dome assembly 212, as an unattached, or separated, fuel-air mixture could present a possible condition for supporting a flame in the event of a flashback.

As it can be seen from FIG. 3, the height of the first passageway 220 tapers as a result, at least in part, of the shape of outer annular wall 214. More specifically, the first passageway 220 has its largest height at a region adjacent the set of main fuel injectors 210 and its minimum height at the region adjacent the second passageway. Alternate embodiments of the dome cap assembly 212 having the passageway geometry described above are shown in better detail in FIGS. 4A and 4B.

Figure 5:
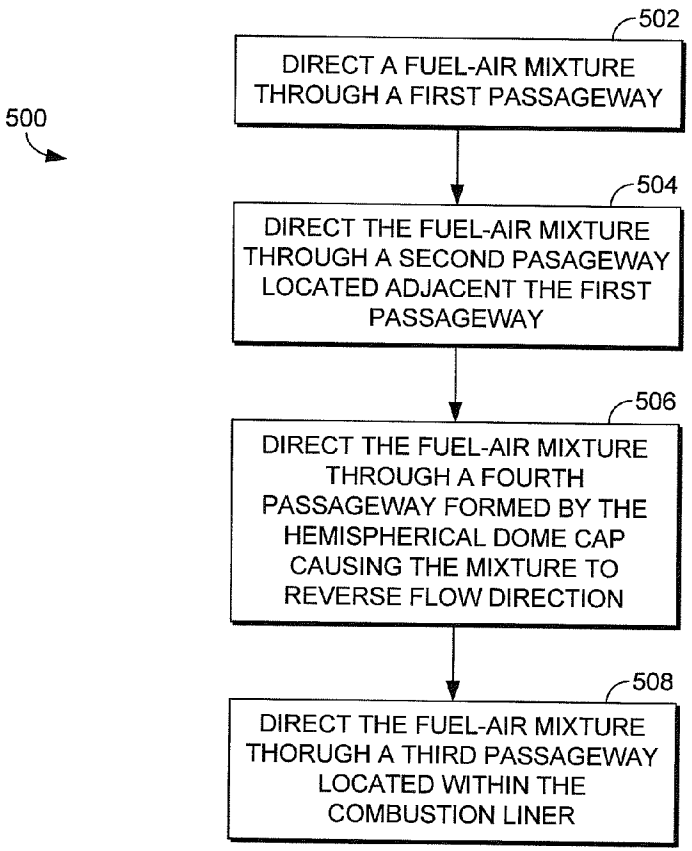
FIG. 5 is a flow diagram disclosing a process of regulating the fuel-air mixture entering a gas turbine combustor.

Turning to FIG. 5, a method 500 of controlling a velocity of a fuel-air mixture for a gas turbine combustor is disclosed. The method 500 comprises a step 502 of directing a fuel-air mixture through a first passageway that is located radially outward of a combustion liner. Then, in a step 504, the fuel-air mixture is directed from the first passageway and into a second passageway that is also located radially outward of the combustion liner. In a step 506, the fuel-air mixture is directed from the second passageway and into the fourth passageway formed by the hemispherical dome cap 216. As a result, the fuel-air mixture reverses its flow direction to now be directed into the combustion liner. Then, in a step 508, the fuel-air mixture is directed through a third passageway located within the combustion liner such that the fuel-air mixture passes downstream into the combustion liner.

As one skilled in the art understands, a gas turbine engine typically incorporates a plurality of combustors. Generally, for the purpose of discussion, the gas turbine engine may include low emission combustors such as those disclosed herein and may be arranged in a can-annular configuration about the gas turbine engine. One type of gas turbine engine (e.g., heavy duty gas turbine engines) may be typically provided with, but not limited to, six to eighteen individual combustors, each of them fitted with the components outlined above. Accordingly, based on the type of gas turbine engine, there may be several different fuel circuits utilized for operating the gas turbine engine. The combustion system 200 disclosed in FIGS. 2 and 3 is a multi-stage premixing combustion system comprising four stages of fuel injection based on the loading of the engine. However, it is envisioned that the specific fuel circuitry and associated control mechanisms could be modified to include fewer or additional fuel circuits.

While the invention has been described in what is known as presently the preferred embodiment, it is to be understood that the invention is not to be limited to the disclosed embodiment but, on the contrary, is intended to cover various modifications and equivalent arrangements within the scope of the following claims. The present invention has been described in relation to particular embodiments, which are intended in all respects to be illustrative rather than restrictive.

From the foregoing, it will be seen that this invention is one well adapted to attain all the ends and objects set forth above, together with other advantages which are obvious and inherent to the system and method. It will be understood that certain features and sub-combinations are of utility and may be employed without reference to other features and sub-combinations. This is contemplated by and within the scope of the claims.

The invention claimed is:

1. A gas turbine combustor comprising:

a generally cylindrical flow sleeve extending along a combustor axis;

a generally cylindrical combustion liner located coaxial to and radially within the flow sleeve, the combustion liner having an inlet end and an opposing outlet end;

a set of main fuel injectors positioned radially outward of the combustion liner and proximate an upstream end of the flow sleeve;

a combustor dome assembly encompassing the inlet end of the combustion liner, the dome assembly extending from proximate the set of main fuel injectors to a generally hemispherical-shaped cap positioned a distance forward of the inlet end of the combustion liner and turns to extend a distance into the combustion liner, such that a first passageway and a second passageway are formed between the combustion liner and a dome assembly outer wall and a third passageway is formed between the combustion liner and a dome assembly inner wall, where the first passageway has a first radial height, the second passageway has a second radial height and the third passageway has a third radial height such that the second radial height regulates the volume of a fuel-air mixture entering the gas turbine combustor;

wherein the first radial height ranges from approximately 15 millimeters to approximately 50 millimeters;

wherein the second radial height ranges from approximately 10 millimeters to approximately 45 millimeters; and wherein the third radial height ranges from approximately 30 millimeters to approximately 100 millimeters, such that the first passageway tapers towards the second passageway to accelerate the fuel-air mixture to achieve adequate flashback margin velocity of 40-80 meters per second to generate a trapped vortex adjacent the combustor liner.

2. The gas turbine combustor of claim 1, further comprising a fourth passageway having a fourth height as measured between the inlet end of the combustion liner and the combustor dome assembly.

3. The gas turbine combustor of claim 1, wherein the largest height of the first passageway occurs at a region adjacent the set of main fuel injectors.

4. The gas turbine combustor of claim 1, wherein the second and third passageways are cylindrical.

5. A method of controlling a velocity of a fuel-air mixture for a gas turbine combustor comprising:

directing a fuel-air mixture through a first passageway located radially outward of a combustion liner, the first passageway having a first radial height;

directing the fuel-air mixture from the first passageway and into a second passageway located radially outward of the combustion liner, the second passageway having a second radial height;

directing the fuel-air mixture from the second passageway into a fourth passageway in a hemispherical dome cap, thereby causing the fuel-air mixture to reverse flow direction; and directing the fuel-air mixture through a third passageway located within the combustion liner and into the combustion liner, the third passageway having a third radial height;

wherein the first radial height ranges from approximately 15 millimeters to approximately 50 millimeters;

wherein the second radial height ranges from approximately 10 millimeters to approximately 45 millimeters;

wherein the third radial height ranges from approximately 30 millimeters to approximately 100 millimeters such that a ratio of the second radial height to the third radial height is approximately 0.1 to 0.5; and wherein the first passageway has a conical-shaped cross section that tapers towards the second passageway;

wherein the second passageway has a cylindrical-shaped cross section; and wherein the third passageway has a cylindrical-shaped cross section.

6. The method of claim 5, wherein the second passageway contains a minimal cross sectional area between the first, second and third passageways.

7. The method of claim 5, wherein the ratio of the second radial height to the third radial height generates a trapped vortex.

8. The method of claim 5, wherein a wall of the combustion liner forms parts of the first, second and third passageways.

* * * * *